US005224706A

United States Patent [19]

Bridgeman et al.

[11] Patent Number: 5,224,706

[45] Date of Patent: Jul. 6, 1993

[54] GAMBLING GAME AND APPARATUS WITH UNEVEN PASSIVE BANKER

[76] Inventors: James L. Bridgeman; Nancy L. Bridgeman; Stephanie A. Bridgeman; Lance F. Bridgeman; Jerry K. Bridgeman; Robert J. Bridgeman, all of 9582 Hamilton Ave., Huntington Beach, Calif. 92646

[21] Appl. No.: 765,159

[22] Filed: Sep. 23, 1991

[51] Int. Cl.[5] ..... A63F 1/00; A63F 9/00

[52] U.S. Cl. ..... 273/85 CP; 273/292

[58] Field of Search ..... 273/85 CP, 138 A, 292

[56] References Cited

U.S. PATENT DOCUMENTS

| | | | |
|---|---|---|---|
| 4,659,087 | 4/1987 | Shen et al. | 273/292 |
| 4,743,022 | 5/1988 | Wood | 273/85 CP |
| 4,926,327 | 5/1990 | Sidley | 273/85 CP |
| 5,022,653 | 6/1991 | Suttle et al. | 273/292 |
| 5,033,744 | 6/1991 | Bridgeman et al. | 273/85 CP |

FOREIGN PATENT DOCUMENTS

| | | | |
|---|---|---|---|
| 2559395 | 8/1985 | France | 273/292 |

*Primary Examiner*—Jessica J. Harrison

[57] ABSTRACT

A game of chance which can be played as a table game or as a computer video game where a player, after making a wager, is dealt a hand of seven cards, which he or she then arranged into a two-card "Tiger" hand and a five-card "Pay" hand. The dealer receives a three-card "Dragon" hand, which remains face down until the player's cards are arranged such that the "Pat" hand is of higher order that the "Tiger" hand. To win the round, the player's "Tiger" hand must have a higher ranking than the dealer's "Dragon" hand. The priority of the winning hand is determined by conventional rules of poker. If the player's "Tiger" hand beats the dealer's "Dragon" hand, the player receives a jackpot which is determined according to the rank of the "Pay" hand.

15 Claims, 5 Drawing Sheets

BEAT THE DRAGON

BANKER DRAGON HAND

PLAYER WINS
WHEN TIGER HAND
BEATS DRAGON HAND

PLAYER TIGER HAND

TIGER HAND MUST BE LOWER
IN VALUE THAN PAY HAND

PLAYER PAY HAND

WINNINGS PAID ON PAY HAND ONLY

GAMBLING GAME AND APPARATUS WITH UNEVEN PASSIVE BANKER

BACKGROUND—CROSS-REFERENCE TO RELATED APPLICATIONS

U.S. Pat. No. 5,046,736 "Imitative-Opponents Gambling Games" provides for video poker which has opponent hands. U.S. Pat. No. 5,033,744 "Card Playing Apparatus With Single Discard Feature" invents a new way to play video poker with graphic symbols to guide players. The subject invention (video version) uses similar hardware, software methods, and payout schemes as the above referenced inventions.

BACKGROUND—DISCUSSION OF PRIOR ART

Most card gambling evolved when players played against other players without professional dealers. The deal rotated around the table with each player receiving the same number of cards for an equal chance to win.

The games closest to the subject invention is Pai-Gow and Pai-Gow Poker because of way the Player arranges hands. Pai-Gow Poker derives from Pai-Gow, the oriental tile (domino type) game. It is a very popular card game among Orientals. The subject invention is played with tiles, dominos, cards or other scoreable units. Scoring rules determine the winners when the units are compared.

In Pai-Gow poker, each Player receives seven cards. Each hand is arranged into a two card front hand, and a five card back hand. The five card hand must be higher than the two card hand, using scoring rules from highball poker.

One Player is the Banker. Each Player front and back hand is compared, respectively, to the Banker front and back hand. The Banker plays heads up (one on one) against each of the other Players. The Banker does not arrange his hand until each Player is done. The Banker cards are left facedown until Players arrange their hands. When the Players' hands are set, the Banker cards are turned faceup and arranged.

To win, the Player's two hands must beat both of the corresponding Banker's two hands. Highball poker rules determine winning hands. When no money exchanges, it is a 'push'. A push occurs if the Player wins the five card hand, but loses the two card hand. A push also occurs if the Player wins the two card hand, but loses the five card hand. Pai-Gow Poker results in about a 50/50 split of wins between Player and Banker.

A gambling video machine requires large bonuses to be successful. Several manufacturers have produced video versions of Blackjack with relatively little commercial success because no big payoffs are practical. This is because the Player and Blackjack dealer win about the same number of times.

The current Pai-Gow Poker offers no Jackpot payoffs for small bets. There are large bets won or lost, but the Banker only matches the Player bet.

Video game manufacturers have not yet solved the way to make a video "Pai-Gow Poker". Since Pai-Gow Poker is so popular, casinos plead for a video version. The 50/50 split (about even odds) between the Player and Banker gives almost no advantage to the house, especially since there are so many pushes. Small house advantages do not allow the payment of large Jackpots. The best a casino pays is double the bet.

Many believe that video draw poker (without opponents) is popular is because it has a payout based on the type of hand held. The more difficult a hand is to achieve, the bigger the payoff. A Royal Flush pays a large bonus; lesser hands pay less. The smaller payout for lesser hands allows the payment of large Jackpots for the best hands. Our new table game version and its video implementation both use a similar system of payout.

OBJECTS AND ADVANTAGES

Accordingly, we have provided a new game with the following objects and advantages.

The preferred embodiment of our invention has no ties while Pai-Gow Poker has many pushes. Our invention pays Jackpots for both table games and video machines. A Casino-Banker remains in place while players come and go. The Banker collects a hold over a period of time, and can pay over eight hundred times a small bet.

This is accomplished by using uneven hands. The Player receives a different number of cards than the Banker from the first and only deal. There are no 'hits'. The Player and Banker do not receive more cards after the original deal.

One of the unexpected results is the flexibility provided by this invention. It works with cards, tiles, dominos and video machines. It adapts to a wide range in the number of pieces used, such as 32 oriental tiles, a 53 card deck with a Joker, or any number of gambling units.

Our invention easily adapts to a stand-alone video machine played by one live player. The machine is the Casino-Banker who pays the live Player. There can be multiple computer Bankers in the video version of our invention. In contrast, the table game can have multiple Players and one Banker.

The Player receives a seven card hand (preferred embodiment) in our invention. The Player arranges the seven cards into a two card Tiger hand, and a five card Pay hand. The Pay hand must be better than the Tiger hand. Unlike Pai-Gow Poker, the Banker-Casino receives only three cards (not seven) for a Dragon hand. Guiding symbols are displayed in the video version to aid the Player.

A hold collects over a period of time, during play, which allows the payment of Jackpot payoffs. The Player gets paid for the handtype of the Pay hand. The pay table is similar to the current draw poker video machines. The payout increases as the Pay hand gets better. A Royal Flush pays a large Jackpot. The casino changes the payoffs to increase or decrease the average hold (or housetake).

The Player faces two challenging constraints. First, the Player Tiger hand must be lower in value than the Player Pay hand. Second, the Tiger hand must then beat the Banker's Dragon hand for the Player to win.

The Player makes a tradeoff. The objective is to increase the payoff, while not losing the game. It is obvious that a stronger Tiger hand usually results in a weaker Pay hand. Of course, this does not always happen. More winnings result when the Pay hand is better, but a low Tiger hand causes the Player to lose.

The Banker, passively, does nothing except hold his cards facedown until game end. Then, the Banker turns the Dragon hand faceup. There is only one Banker hand, not arranged into two hands like the Player. The Banker Dragon hand competes against the Player Tiger hand only. Since there is only one hand to compare, wins are determined more quickly.

Exciting, unexpected results are the result of using uneven, passive Banker hands with some of the flavor of Pai-Gow, and payouts like video poker.

SUMMARY

We have a new game where a Player and a Banker have different numbers of cards, tiles, or dominos from the start. An active Player selects two of seven cards to compete against three cards of a passive Banker.

It is a new table game suitable for casinos and it plays well in a video machine. The Player arranges a hand into a Tiger hand and a Pay hand. The Tiger hand must be lower in value than the Pay hand. The video version shows guiding symbols to assist the Player. The Banker receives a Dragon hand which stands. The Banker is passive throughout the game. Once the Player sets his cards, the Banker turns the Dragon hand faceup. The Player wins if the Tiger hand beats the Dragon hand. The Player Pay hand determines the size of the payoff. This results in large Jackpots.

The Player arranges card hands like Pai-Gow Poker, and a pay table similar to video draw poker is used. This new invention as a table game, or video poker machine, is exciting because it pays large Jackpots. There are no ties (preferred embodiment). It is commercially feasible because a reliable hold for a casino is possible.

DRAWING FIGURES

DRAWING REFERENCE NUMERALS

Figure 1:
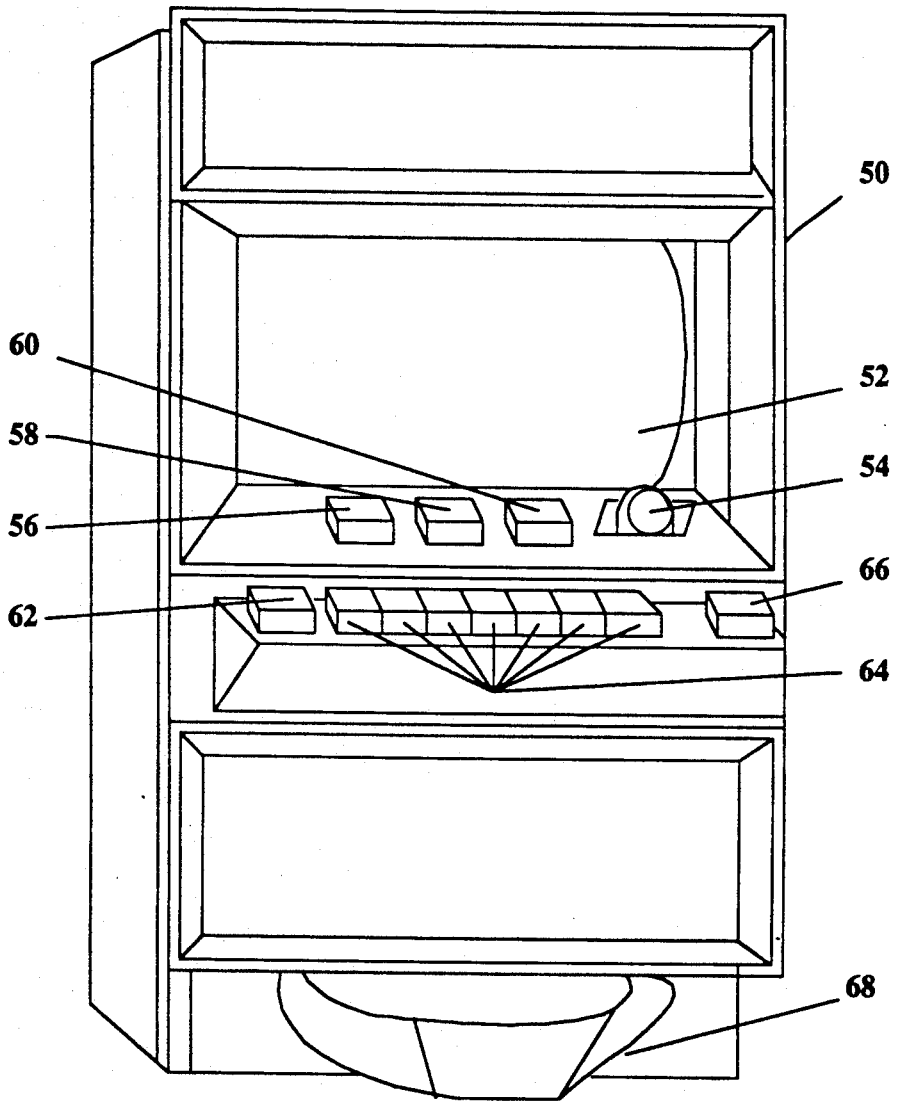
FIG. 1 is a perspective view of an electronic video Uneven, Passive Hands poker machine according to the present invention.

50 cabinet of video Uneven, Passive Hands poker game machine.
52 Cathode ray tube (CRT).
54 coin/credit inlet.
56 COLLECT button.
58 PLAY 1 CREDIT button.
60 PLAY MAX CREDIT button.
62 TAKE button.
64 MOVE buttons.
66 DEAL button.
68 coin/credit outlet.
200 central processing unit to execute instructions.
202 read only memory (ROM) to store permanent data.
204 random access memory (RAM) to store volatile data.
206 cathode ray tube controller.
208 circuit to refresh memory 200.
210 read only memory of 206.
212 video circuit for displays.
214 cathode ray tube.
216 clock circuit.
218 in/output port for 236, 238, 240.
220 input/output port for 242.
222 input/output port for 244.
224 input buffer for buttons or keys 236.
226 drive circuit for 238, 240.
228 buffer for coin or credit acceptor 242.
230 drive circuit for 244.
232 buffer for disk drive 244.
234 drive circuit for 244.
236 key activators (buttons), light pen, and touch screen.
238 light circuit.
240 sound generator.
242 coin or credit.
244 disk drive, permanent storage device.

DESCRIPTION—FIG. 1

FIG. 1 shows a perspective view of a video Uneven, Passive Hands poker machine, according to our invention. The video monitor displays cards and other symbols. The machine services button actions, collects bets and makes payoffs. Payoffs are credits, points or coins.

The machine's cabinet is about 100 cm high, 45 cm wide, and 45 cm deep. It includes a cathode ray tube 52 or like display panel hardware.

The Player inserts the proper number of coin(s) in a coin/credit inlet 54 to begin playing the game. The coin inlet connects to a coin hopper (which includes a coin/-credit outlet 68) which stores coins and disperses payoffs to winners.

The Player sets the bet by choosing either PLAY 1 CREDIT button 58 or PLAY MAX 60. The Player can repeatedly hit the PLAY 1 CREDIT 58 to bet 1, 2, 3, or more coins to the game limit. The PLAY MAX 60 bets the game limit coin bet. In the preferred embodiment, the Player receives seven cards faceup, after pushing the DEAL button 66. Simultaneously, the Banker receives three cards, facedown. Tiles or dominos are appropriate for our invention, and could be used instead of cards. Since the cards on the screen are only visual images, pictures of tiles (dominos, or other units) can be substituted. The number of cards, tiles, or dominos can vary widely. There can be 32 tiles or dominos, a 53 card deck with jokers, or any number of units.

It is difficult to follow instructions when there are several hands. So the various hands have different names to identify them. The graphic names for the different hands make it easier to instruct the Player. A Tiger on the screen contains one of the hands. The Player can see the Tiger and better understand directions to move cards there.

The Player moves two of the seven cards into a separate Tiger hand. The name of the Tiger hand maintains an Oriental theme. To move a card, push one of seven MOVE buttons 64 directly under a displayed card. (A tile, domino or other unit image could also be moved.) Touch the screen card image, with a light pen or touch screen device, if applicable.

Reverse a move action by pushing the same MOVE button 64 again, if a mistake or change of mind occurs. The card will return to its original spot. Also, touch the moved card image with a light pen or touch screen to reverse the move. Move cards to the Tiger hand, and back, until the arrangement satisfies the Player.

The Player hand must be correctly arranged. Otherwise, the game cannot proceed. The Tiger hand point value must be lower than the value of the Pay hand (five remaining cards not moved). A message will immediately tell the Player, if the Tiger hand is larger than the Pay hand. Another solution is to prevent the Player from moving an offending card if it makes the Tiger hand too large.

The Player arranges seven original cards into five cards (Pay hand) and two cards (Tiger hand). Then the Player pushes the TAKE button 62. The Banker three cards (Dragon hand) are now turned faceup. The Dragon hand compares to the Player's Tiger hand. The "Beat The Dragon" name states the object of the game. To win, the Player Tiger hand must beat the Banker Dragon hand. The game is over.

The Player wins when the Tiger hand beats the Dragon hand. Then, the payoff computes from a predetermined pay schedule. The handtype of the five card Pay hand determines the win amount. The win amount adds to the credits, updating the credits display. The Player collects credit winnings by pushing a COLLECT button 56. The credits convert to winnings as coins dropped in the tray of coin/credit outlet 68 (or printed as a pay ticket by a printer device).

Besides keys, other Player input controllers are available. Light pens, touch screens or similar devices also move cards to the Tiger hand, and back.

DETAILED DESCRIPTION—FIG. 2

Figure 2:
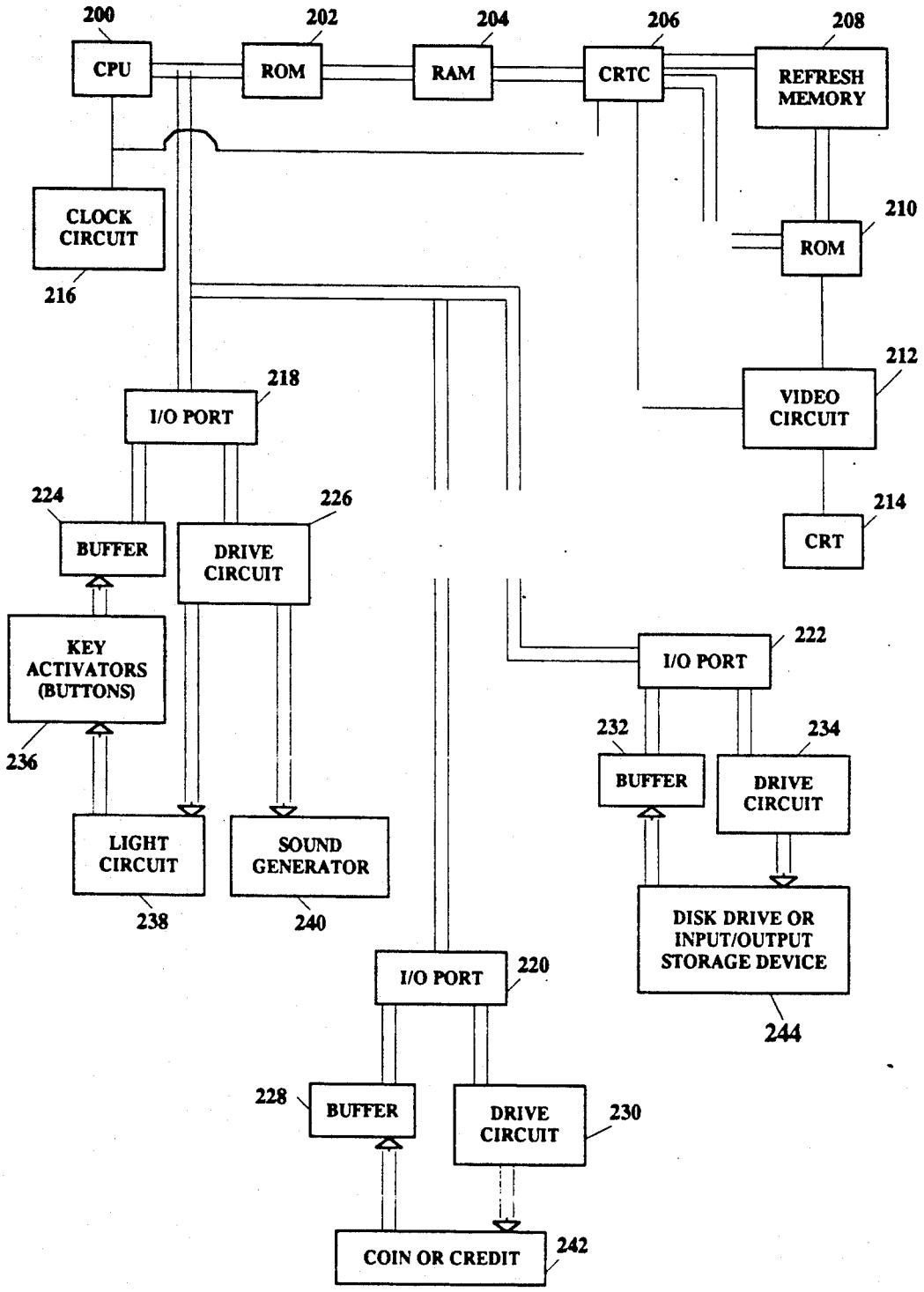
FIG. 2 is a circuit block diagram for the video Uneven, Passive Hands poker machine of FIG. 1.

FIG. 2 shows a block diagram of a circuit for our video poker machine (FIG. 1).

A CPU (Central Processing Unit) 200 executes various operations and does processing while accessing memory locations in RAM (Random Access Memory) 204. The program transfers from ROM (Read Only Memory) 202 to operate in RAM 204. Other possible storage devices include: static memory, magnetic disks, magnetic tapes, paper tape, and laser storage. A battery backed RAM 204 keeps the game variables stored if power goes down. Stored electronic meter and prior recall information is preserved for about 10 years, when power is removed from the gaming device.

ROM 202 and RAM 204 make up the memory storage area. RAM is alterable when operating the game, and can be written over. "Read and Write Memory" is a more descriptive term for RAM. While ROM is also a random access memory, it is not erasable and cannot be written on. Turning off the power supply does not effect ROM.

CPU 200 controls the input/output (I/O) port 218 which includes key activators (buttons), light pen, and touch screens 236. The buttons start actions such as PLAY 1 CREDIT 58, PLAY MAX 60, and TAKE 62. Other buttons actions include MOVE 64, DEAL 66 and COLLECT 56.

CPU 200 also executes input/output operations through I/O port 222 to a buffer 232 and a drive circuit 234 for permanent mechanical storage devices. The mechanical storage devices include magnetic disk, magnetic tape, and cartridges 244. The input/output operations are used for management systems, progressive meters and player tracking.

CPU 200 controls the coin operation or credit setting device 242 that is mechanical or electronic, or both. This is done through I/O port 220 by a buffer 228 and a drive circuit 230. The coin operation is crucial to operating a video poker machine. The coin hopper must be able to store coins and make payoffs in the correct amount. The coin hopper is monitored always. Error messages are displayed immediately when the game is shut down. Some serious messages are "RUNAWAY HOPPER," "HOPPER SWITCH UP", "COINS OUT," and "HOPPER EMPTY." Some gambling jurisdictions require paper ticket printers instead of coin hoppers. Printers made especially for video poker machines fit in the same space as a coin hopper.

Our video poker game operates in ROM 202 or RAM 204 under control of CPU 200. It clears and restores memory 208. A CRT Controller 206 reads out the image pattern (memory bit map) for a card from ROM 202 into RAM 204. It converts this data in parallel format to serial data format, and sends it to video circuit 212. A predetermined image appears on CRT 214, based on the video signals generated.

Various sequences require close timing when operating the game. In addition to the timing sequences of the coin hopper, various messages may appear for three seconds, others for five seconds, such as "INSERT COIN", etc. A clock circuit 216 sends out clock signals to control the timings of CPU 200, and CRT Controller 206. The random number seed is taken from a clock signal. There is a constant generating of random numbers since this is a card game and the cards must be dealt randomly.

Buffers are needed since the CPU is a single task processor and the buffer 224 holds instruction activator/key 236 input information. The processor may be off checking the coin acceptor when a button is pushed. A drive circuit 226 controls the light circuits 238 that light up the buttons, the lights show the key activators 236 that are ready to accept input data.

A sound generator 240 signals the Player to acknowledge the pressing of a key, or that a win has occurred. Each bonus win has different time spans of musical phrases played.

Drive circuit 230 drives a coin/credit detection device 242. It executes a credit detection, lock out and coin release operation. Also, a buffer 232 holds the input from a memory storage device, such as a disk drive 244. CPU 200 directs the flow of data into RAM 204. A drive circuit 234 drives a memory storage device 244 to execute reads/writes for data and statistics. A management key used only by authorized personnel is turned to get statistics that are shown on the screen, or sent to hardcopy devices 244. Statistics include data such as rounds played, wins, and net coins. Other data includes amount of winnings, percentage of hold, and other game information.

Many details do not appear in the above hardware description. To one skilled in the art, these omitted details are obvious. All hardware for the our video poker machine is similar to existing video poker machines. The coin hoppers, coin acceptors, and hard meters are standard equipment. Other standard equipment includes IBM compatible computers, screen monitors, and VGA graphic display cards. It is relatively simple for an experienced engineer in the gaming business to construct a comparable machine.

DETAILED DESCRIPTION—FIG. 3

Figure 3:
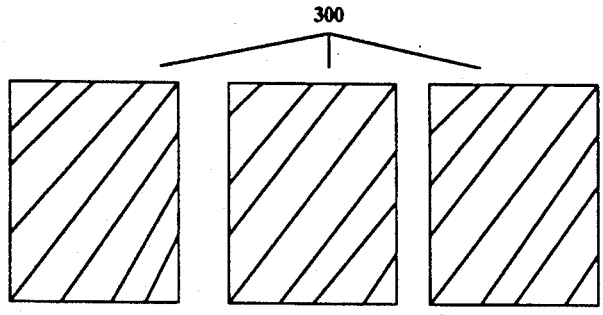
FIG. 3 illustrates the layout of the cards, tiles, or dominos as a table game. The same layout is used for our video Uneven, Passive Hands poker machine of FIG. 1.
Figure 3:
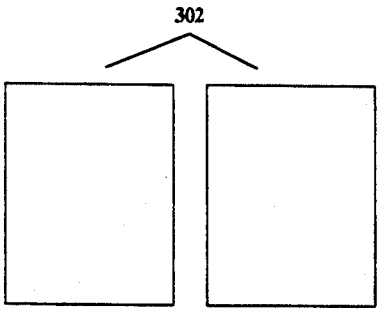
Figure 3:
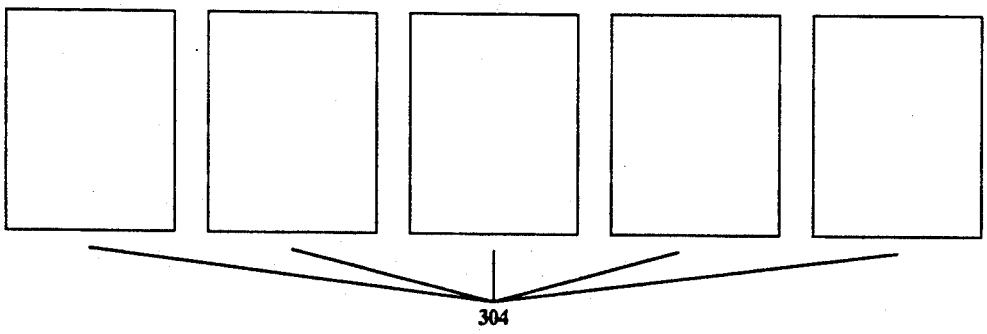

FIG. 3 illustrates a typical layout of cards, tiles or dominos for a table game in a casino. The same layout is also used for the video version. The layout would have areas set aside for the three hands shown: Banker Dragon hand, #300; Player Tiger hand, #302; and the Pay hand, #304.

Felt tops are used for all casino table games. The table felt layout would be similar to ones used for Pai-Gow Poker. The main difference is the artwork and space set aside for the uneven, passive Banker Dragon hand. Artwork includes a dragon and a tiger to show the playing areas for the respective hands. This quickly orients the Player in the right direction.

A professional dealer representing the Casino's interest holds the Banker Dragon hand #300. Seven original cards are dealt to each Player on the spaces set aside for the Player. Several Players play against one Banker. The layout in FIG. 3 shows the table after the Player has moved two cards to the Tiger hand (#302). The remaining five cards (#304) is the Pay hand.

The layout of the table also includes certain rules of the game. Under the Dragon hand #300, a message says: "PLAYER WINS WHEN TIGER HAND BEATS DRAGON HAND". Under the Tiger hand #302, a message explaining the Tiger hand appears: "TIGER HAND MUST BE LOWER IN VALUE THAN PAY HAND". Under the Player Pay hand #304, a message explains "WINNINGS PAID ON PAY HAND ONLY".

Number 300 shows where the three cards of the Dragon hand (Banker) are dealt facedown. As soon as the Player cards are ready (arranged), the Banker turns up the Dragon hand #300. If the Tiger hand #302 is higher in value than the Pay hand #304, the Player will lose automatically. In table play, this is necessary to keep play moving and to keep cheating down. If the Tiger hand #302 has been arranged correctly according to the rules, a comparison is made between the Tiger and Dragon hands.

The Player wins if the Tiger hand #302 beats the Dragon hand #300. The amount of Player win is based on the Pay hand at #304. The winnings are based on a posted pay table with a large bonus for a Royal Flush. Smaller payouts are paid for lesser hand types. Either the dealer collects the Player bets, or the Player receives the appropriate winnings.

The payoff for the Pay hand can be adjusted depending upon the value of the Tiger hand. The Player would take this into account when selecting two cards for the Tiger hand. For example, a Tiger hand without even a pair and a high card of nine (9) could double the Player win. This would add another dimension to the play.

Flow Chart for Uneven, Passive Hand Video Poker Game

Figure 4:
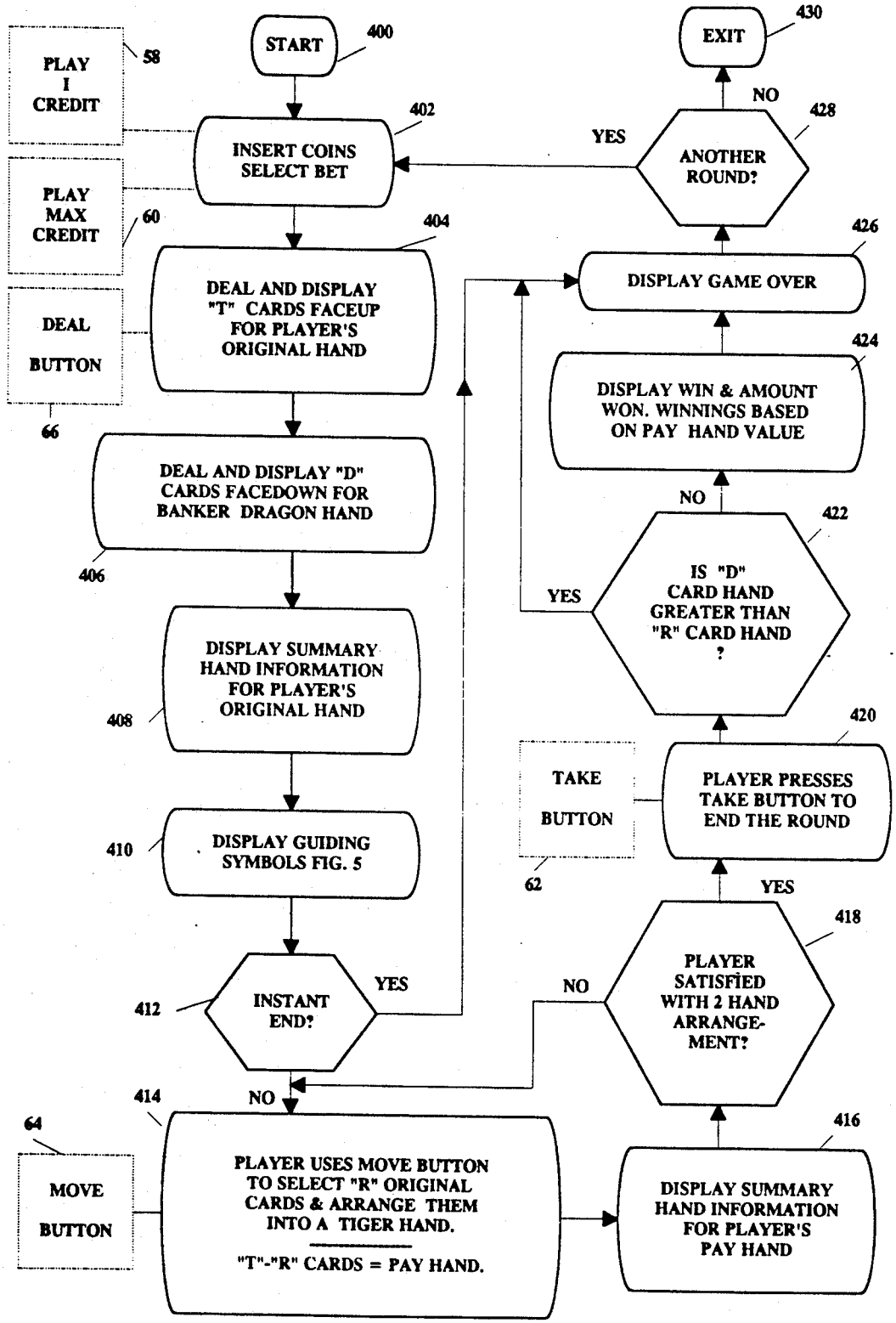
FIG. 4 is a flow chart for our video Uneven, Passive Hands poker game machine of FIG. 1.

FIG. 4 is a flowchart for Uneven, Passive Hand video poker, an embodiment of our invention. The operating steps of a computer program are outlined. It tells how the game plays when shown on a video screen.

A casino game requires around a five percent hold. This hold, or housetake, covers overhead expenses. It also pays Jackpots. Large bonuses make for more Player excitement.

We introduce a startling new concept for card gambling here. Specifically, we introduce uneven hands between a Player and a passive Banker. A Banker Uneven, Passive Dragon hand plays against a Player Tiger hand. The Uneven, Passive Hand make it possible to collect enough hold to pay large Jackpots.

The Uneven, Passive Banker hand eliminates ties. This is achieved by comparing only two cards (Tiger hand) to three cards (Dragon hand). Pai-Gow Poker compares two Player and Banker hands which have an equal number of cards (one hand has two cards and one has five cards).

The game is faster than Pai-Gow, since there is one fewer hand comparison. Only one Uneven, Passive Hand comparison is made between Player (2 cards) and Banker (3 cards) to determine a win.

The process starts (step 400) for our Uneven, Passive Hand video poker. The Player deposits coins (step 402) into the video poker machine. Then the Player selects the PLAY 1 CREDIT button 58 or the PLAY MAX CREDITS button 60. The Player repeatedly pushes the PLAY 1 CREDIT 58, until reaching the desired amount of coins bet. The PLAY MAX CREDITS 60 will bet the game design limit amount, such as ten coins.

The Player receives "T" original cards faceup. In the preferred embodiment, "T" is the number 'seven'. Pressing the DEAL button 66 causes the dealing and display of "T" cards on the monitor 52 in step 404.

Simultaneously, the computer Banker receives "D" cards facedown for its Uneven, Passive Dragon hand (step 406). "D" and "T" specify different numbers of cards. "D" represents three cards in our preferred embodiment. Hence, the Player and Banker hands are not even. The Player starts with seven cards and selects two to play against three Banker cards.

Our patent title becomes obvious. The Banker and Player have uneven (different) numbers of cards in their hands. The Banker has fewer cards than the Player, a disadvantage for the Banker. This disadvantage evens out because of certain game rules. The Player picks and plays two of the original "T" cards with an important restriction. The two card Tiger hand must be lower in value than the remaining five Player cards, called the Pay hand. The Player overall gets lower Pay hands because of this. Holds increase for the Casino-Banker as a result. This makes it possible to pay Jackpots for very good Pay hands.

Step 408 displays the summary hand information for the Player's original hand. The display shows the handtype and handrank of the hand. This information tells that the hand is a pair of kings, an ace straight, a nine flush, etc.

U.S. Pat. No. 5,033,744, "Card Playing Apparatus With Single Discard Feature," uses guiding symbols. Guiding symbols speed play of the game sometimes cutting the time in half. The subject invention also uses guiding symbols to teach the novice Player how to play the game. However, any Player can utilize guiding symbols to more easily see which cards to move.

Figure 5:
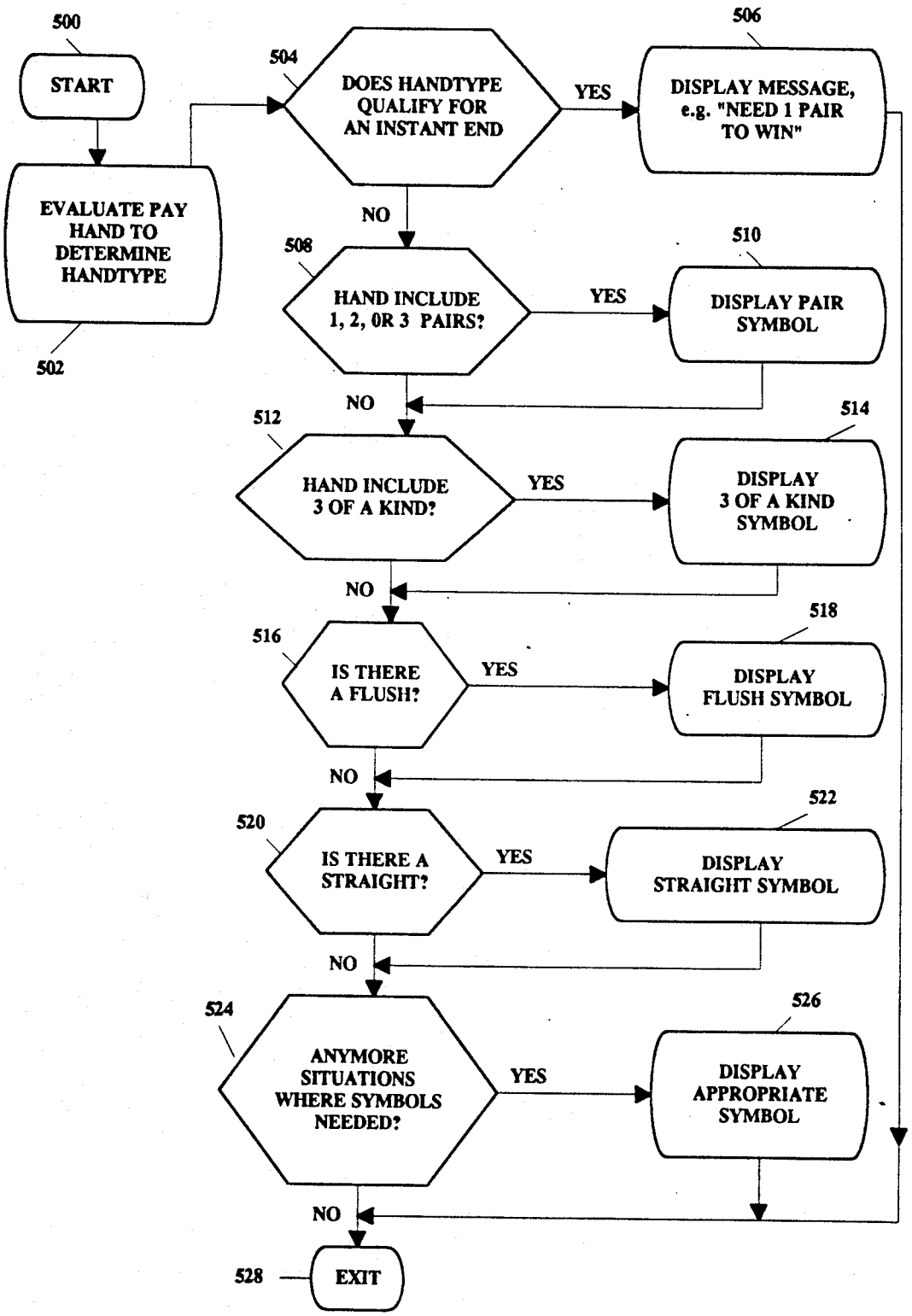
FIG. 5 is a flow chart showing when to display guiding symbols in the video version of Uneven, Passive Hands poker.

Step 412 displays the guiding symbols. FIG. 5 presents a more comprehensive explanation for these displays. The guiding symbols appear near the appropriate card images. They appear on, below, above, or to the left or right of the cards. Overlapping symbols hook cards together. Overlapping symbols identify pairs, three of a kind, four of a kind, and five of a kind hands. Of course, this helpful aid applies only to the video version of our invention.

Sometimes, a Player receives a hopeless poker hand. The Player gives up and throws away the hand. Play then continues to the next round. Step 414 allows for this by employing an instant end. Perhaps a high card hand, without even a pair, would be an instant end. An instant end automatically ends the round with no further dwelling on the hand. The handtype and handrank criteria for instant ends are game design parameters. If there is an instant end, then the process goes to step 428.

If no instant end, the Player moves "R" cards into a Tiger hand (step 416). The remaining "S" cards not moved, go to a Pay hand. A MOVE button 64 is the vehicle to select the card to move to the proper position. A light pen, a mouse, touch screen or similar device also selects and moves cards around.

The Player arranges his cards into a Tiger hand and a Pay hand. Display the payoff amount for the Pay hand. This assumes the Player might win, and shows the potential win amount. However, the Player Tiger hand must first beat the Dragon hand. The summary hand information (step 418) updates each time the Pay hand changes. The summary hand data display shows the new handtype and handrank.

The handtype is one selected from a classification group, including one pair, two pairs, three of a kind, straight, flush, and full house. Further entries in the group include four-of-a-kind, straight flush, Royal Flush, and Five-of-a-Kind. The handrank is the single card number used to show the high card of the handtype. A queen flush means that flush is the handtype, and queen is the handrank.

The Tiger hand must be lower in point value than the Pay hand. This is easy enough since there ar only two cards (Tiger hand) compared to five cards (Pay hand), in the preferred embodiment. House rules apply for the table version of our invention. The Player could automatically lose if he violates this rule. That is, the Player gets no second chance if the Tiger hand is larger; the Player loses his bet.

In our preferred video embodiment, we display an error message. The Player corrects the illegal condition by repeating step 416. The Player moves cards back and forth between the Tiger hand and the Pay hand until satisfied.

The Player can reverse the movement of the cards. If Player not satisfied with the two hand arrangement (step 420), go to step 416 where the Player tries again. If the two card (Tiger hand) arrangement is satisfactory, the Player presses the TAKE button 62 to end the round (step 422).

Step 424 determines who wins according to game rules. The Player's two Tiger cards must beat the Banker's three Dragon cards. If so, the Player wins.

In step 426 determine the win condition. Then, display the Tiger or Dragon winner status. If the Tiger hand is higher than the Dragon hand, the Player wins. The Pay hand determines the amount of the win. Display the amount of the win here. A "WINNER" display message also appears along with a jubilant, winning Tiger. If the Player loses, a "GAME OVER" message appears along with a sulking, losing Tiger and a fire-breathing, winning Dragon.

The player win comes only from the Pay hand value (step 426). (However, the payoff could be adjusted for the value of the Tiger hand.) The Tiger must beat the Dragon to win. A high Pay hand representing a large payoff is no good, if the Tiger hand loses to the Dragon hand. Considerable dynamics are going on in the interactions between the hands. The Player's Tiger hand collides with both the Player Pay hand and the Banker's Dragon hand.

Each game takes just seconds to play, so the Player will play round after round. Step 428 asks if Player wants to play another round. The Player keeps playing by putting in another coin or using his credits to play another game in step 402.

The Player quits by exiting at step 430. The Player first collects any winnings by pushing the COLLECT button 56. If no winnings, the Player exits at step 430.

Flow Chart to Display Guiding Symbols—FIG. 5

FIG. 5 is a flowchart showing when to display guiding symbols for our game. It amplifies FIG. 4, step 412.

Inappropriate use of symbols on top of symbols would be redundant. The cards themselves are symbols. They contain all sorts of symbols for faces, numbers, clubs, diamonds, hearts and spades. The previous invention, 'Card Playing Apparatus with Single Discard Feature' (U.S. Pat. No. 5,033,744) used guiding symbols. They are helpful and players appreciate their help.

This invention also needs guiding symbols. The casino wants the Player to process quickly the original card hand for fast play. Guiding symbols help play by showing logical card groupings, thereby helping the Player arrange them. The symbols significantly lower the time it takes to play the game and makes for extremely fast play.

At step 500, the Player receives an original seven cards (preferred embodiment). An evaluation of the original cards begins (step 502). A random number generator selected the original cards randomly. Before displaying the cards, order them left to right in numerical order. Wild cards or Jokers go first (or possibly last). The smallest numerical cards go next. The highest numerical cards go last. Then display the cards in the new order. This helps the Player arrange the Tiger and Pay hands more quickly. Straight handtypes are obvious with an ordered hand. Compute the handtype for the Player hand, and display it. The computed handtype is the best card combination found in the original hand.

When the handtype for the originally dealt cards is too low, the game allows for an instant end (step 504). A display message "HAND TOO LOW TO PLAY" appears. It tells the Player that the hand value is less than needed to play the game. To continue play, the hand must be higher than handtype "X" with handrank "Y" (where "X" and "Y" are game parameters). The instant end feature helps to weight the payoff toward larger payoffs (step 528). This reduces the number of small payoffs while increasing the payoff for Jackpots.

If not an instant end, step 508 determines if the handtype is one or two pairs. If it is, indicators are set in step 510 to display a pair guiding symbol. The cards being ordered numerically, allows the pair symbol to overlap two cards of a pair. This visually hooks the cards together. Alternatively, the pair symbol appears directly on both cards of the pair group.

Identifying the pairs is very helpful, since the Tiger hand has only two cards (preferred embodiment). A pair in the Tiger hand will normally beat the Banker's Dragon hand. A pair in the Tiger hand is ideal if lower than the Pay hand.

The pair symbol is a hand extending two fingers. It looks like a 'peace' or "V for Victory" sign. Another symbol for pair cards is a pear (the fruit). Seven cards make it possible to have three different pairs groups in the hand. Display pair symbols for one, two or three pair groups. The hand may require more than one type of guiding symbol. Pair symbols are compatible with straight and flush symbols, that is, they can occur simultaneously. Analysis of the card hand continues for other symbols. The process would continue to step 512.

Step 512 determines if the handtype is three of a kind. If so, indicators are set in step 514 to display the three of a kind symbol. We use an 'okay' sign with three fingers extended for a three of a kind symbol. Seven cards make it possible to have two different three of a kind groups in the hand. A three of a kind symbol is compatible with straight and flush symbols. A search continues to look for other symbol requirements. Go to step 516.

Step 516 determines if the hand contains a flush. If so, indicators are set in step 518 to display flush guiding symbols. The flush guiding symbols consist of flashing the suit symbol (spade, heart, diamond, or club symbol) on the card image. The color of the suit symbol changes to catch the attention of the Player. Another approach is to display a non-flush symbol (say an exclamation point) on the cards not part of the flush hand.

Step 520 determines if the hand contains a straight. If so, indicators are set in step 522 to display straight guiding symbols. (step 522). The number on the card is the focus, and it can flash, change color, become larger or smaller. Alternatively, display a non-straight guiding symbol (say a question mark) on those cards not part of the straight. After displaying straight symbols, the search is over at step 528.

When the Player has a straight or flush, the game gets exciting. Larger payoffs become possible with the better type hands. The Player hopes that two high non-straight or non-flush cards are available for the Tiger hand. A strong Tiger hand increases the chances for a win. If not available, the Player breaks a straight or a flush hand to try for a smaller win amount.

A four-of-a-kind guiding symbol creates an exciting graphic effect. Other special guiding symbols include those for Five-of-a-Kind, Royal Flush and straight flush handtypes. Mostly for show and electrifying appearance, these quite dramatic displays create Player excitement. Step 524 looks for these situations. Step 526 displays these special symbols.

Finally, all guiding symbols, (for all handtypes) could be the same symbol. One symbol only could be used. For example, a bright star symbol could be displayed on those cards making the handtype. That is, a star appears on the five cards making a straight, or on the two cards making a pair, etc. No other symbol would be used in this situation.

Operating Video Uneven Hands Poker Machine

FIG. 1

The following gives an operating perspective of our video Uneven Hands poker machine. It is from the Player viewpoint while operating the video Uneven Hand poker machine of FIG. 1.

The machine is already on line waiting for the Player to play. An "INSERT COIN" message flashes on the video screen until a Player inserts a coin into the coin inlet 54. Each entered coin adds to a displayed coin total. Then a "PLEASE BET" message appears on the video screen 52. The video screen 52 is encased in a game machine cabinet 50. The Player betting one credit pushes PLAY 1 CREDIT 58.

The Player pushes the DEAL button 66. The Player receives seven original cards faceup, and the Banker receives three Dragon cards facedown (preferred embodiment). The Player will see the Player's cards, but not the Banker's cards until the end of the round. The video Banker is strictly a passive computer opponent.

If the seven card hand contains a high enough value (design parameter), say a pair, the game continues. If not high enough, the game ends when using the instant end feature. A message, such as "NEED PAIR TO PLAY" appears. A "GAME OVER" message quickly follows. The player may lose his opening bet depending on the house rules. The player's bet is either returned, or kept by the Casino-Banker.

Summary hand information and guiding symbols appear on the screen. Also, the preferred embodiment orders Player cards numerically for player convenience. The Player arranges the original seven cards into a Tiger hand (two cards), and a Pay hand (five cards). This is the preferred embodiment.

The Player pushes the MOVE buttons 64 to arrange the hands. Seven MOVE buttons 64 are directly under the seven original cards. Pressing a MOVE button 64 causes the card associated with it to appear immediately in one of the two Tiger card slots.

After the Player moves two cards to the Tiger hand, the remaining five cards that are not moved become the Pay hand. The Tiger hand must be lower in point value than the Pay hand, according to Highball poker rules. The player cannot put just any two cards in the Tiger hand.

If the Player is slow in responding, prompts will appear to help the Player. "PUSH MOVE BUTTON," is one of the messages. If the two cards in the Tiger hand are higher than the Pay hand, another message says, "TIGER HAND TOO BIG." The Player can reverse the previous move actions. The player just pushes the same move buttons 64 pressed before. This moves the cards from the Tiger hand back to their original positions.

After arranging the hand correctly, displays will update for the Pay hand. The summary hand information and the guiding symbols for the original seven card hand are no longer appropriate. The player then pushes the TAKE button 62 to end the game. If there is too long a delay before the Player pushes the TAKE button 62, a "PLEASE TAKE" message, appears.

If the Tiger hand beats the Dragon hand, a "WINNER" message appears. The amount won shows on the screen, and the credits display updates. If the Player loses, a "GAME OVER" message appears.

To collect the winnings, the Player pushes COLLECT button 56 which activates the coin hopper to pay out the coins into the coin/credit outlet 68. Alternatively, a printer device prints a pay ticket.

The results of the last game is left displayed on the video monitor 52. This display attracts the next player to the game. AN "INSERT COIN" flashes on and off to help a Player start the next game.

SUMMARY, RAMIFICATIONS, SCOPE

Our invention has Uneven, Passive Hand with play like Pai-Gow Poker and paytables like video Draw Poker. Our new game pays large Jackpots, eliminates ties and plays fast.

The gambling industry diligently seeks new video poker games that pay large Jackpots. We meet that need with the unobvious solution of Uneven, Passive Hand. The Player arranges an original Player hand (seven cards) similar to Pai-Gow. The Player makes a "Pay hand" (five cards) and a "Tiger hand" (two cards). The video version displays guiding symbols to help the Player. The Player now owns two hands. The Tiger hand must have a lower value than the Pay hand. The Player's Tiger hand of two cards must beat the Banker Dragon hand of three cards to win. The Dragon hand is facedown and passive until the end of the round. After the Player finishes arranging his two hands, the Banker turns the Dragon hand faceup. The Tiger hand must beat the Dragon hand for the Player to win. The value of the Player Pay hand determines the amount of the winnings. Rewards increase as the Pay hand gets better.

The player plays for large Jackpots in this new game of Uneven Hands video poker.

While our above description contains many specificities, these should not be construed as limitations on the scope of the invention, but rather as an exemplification of preferred embodiments thereof. Accordingly, the scope of the invention should be determined not by the embodiments illustrated, but by the appended claims and their equivalents.

We claim:

1. A method of playing a game of change utilizing a plurality of scorable units wherein said scorable units form sets having different rankings, said method comprising the steps of:

a player placing a wager with a dealer;

said player randomly receiving an original set of said scorable units, said original set containing A scorable units, where A is an integer;

said dealer randomly receiving a first set of said scorable units, said first set having B scorable units where B is an integer and B is not equal to A, said first set having a first-set ranking;

said player arranging said original set into a second set having C scorable units and a third set having D scorable units where C and D are integers, such that C+D=A, said second set having a second-set ranking, said third set having a third-set ranking;

said first-set ranking being compared to said second-set ranking to determine if said player has lost or won said wager; and said player receiving a jackpot if said player has won said wager, said jackpot being determined according to a pay schedule calculated in proportion to said third-set ranking.

2. The method recited in claim 5 wherein said first-set ranking is concealed from said player when said dealer receives said first set, said first-set ranking being revealed to said player when said dealer compares said first-set ranking to said second-set ranking to determine if said player has won or lost said wager.

3. The method recited in claim 1 wherein said third-set ranking is greater than or equal to said second-set ranking.

4. The method recited in claim 1 wherein said player wins said wager if said second-set ranking is greater than said first-set ranking, said player losing said wager if said first-set ranking is greater than said second-set ranking.

5. A method of playing a game of chance utilizing a computerized video-game machine capable of displaying images of scorable units on a video-display screen wherein said scorable units form sets having different rankings, said video-display screen having a first-set dealer zone, an original-set player zone, a second-set player zone, and a third-set player zone, said method comprising the steps of:

a player registering a wager with said computerized video-game machine;

said player directing said computerized video-game machine to randomly generate an original set of scorable units containing A scorable units and a first set of scorable units containing B scorable units where A and B are integers and B is not equal to A, said original set being displayed in said original-set player zone and having an original-set ranking, said first set being displayed in said first-set dealer zone and having a first-set ranking, said first-set ranking being concealed from said player;

said computerized video-game machine displaying guiding means for helping said player to evaluate said original-set ranking;

said player directing said computerized video-game machine to arrange said original set into a second set having C scorable units and a third set having D scorable units where C and D are integers, such that C+D=A, said second set having a second-set ranking, said third set having a third-set ranking, said-third set ranking being greater than or equal to said second-set ranking;

said computerized video-game machine comparing said second-set ranking to said third-set ranking;

said computerized video-game machine displaying said second set in said second-set player zone and said third set in said third-set player zone only if said third-set ranking is greater than or equal to said second-set ranking, said computerized video-game machine requiring said player to rearrange said second set and said third set if said second-set ranking is greater than said third-set ranking;

said player directing said computerized video-game machine to reveal said first-set ranking to said player and to compare said first-set ranking to said second-set ranking to determine if said player has won or lost said wager, said player winning said wager if said second-set ranking is greater than said first-set ranking, said player losing said wager if said first-set ranking is greater than said second-set ranking;

said player receiving a jackpot if said player has won said wager, said jackpot being determined according to a pay schedule calculated in proportion to said third-set ranking.

6. A method of playing a game of chance utilizing a plurality of playing cards and a playing area wherein card hands are ranked from low to high in order of high card, pair, two-pair, three-of-a kind, straight, flush, full house, four-of-a-kind, straight flush, royal flush, and five-of-a-kind, said game of chance being administered by a dealer, said playing area comprising a first-hand dealer zone, a second-hand player zone, and a third-hand player zone, said method comprising the steps of:

a player placing a wager with said dealer;

said player receiving an original hand having A random cards where A is an integer;

said dealer receiving a first hand having B random cards where B is an integer and B is not equal to A, said first hand being placed face down in said first-hand dealer zone, said first hand having a first-hand ranking;

said player arranging said original hand into a second hand having C cards and a third hand having D cards where C and D are integers, such that C+D=A, said second hand having a second-hand ranking, said third hand having a third-hand ranking, said third-hand ranking being greater than or equal to said second-hand ranking, said second hand being placed in said second-hand player zone, said third hand being placed in said third-hand player zone;

said first hand being turned face up and said first-hand ranking being compared to said second-hand ranking to determine if said player has lost or won said wager, said player winning said wager if said second-hand ranking is greater than said first-hand ranking, said player losing said wager if said first-hand ranking is greater than said second-hand ranking; and said player receiving a jackpot if said layer has won said wager, said jackpot being determined according to a pay schedule calculated in proportion to said third-hand ranking.

7. The method recited in claim 6 wherein said plurality of playing cards is 52.

8. The method recited in claim 7 wherein said plurality of playing cards further includes a Joker.

9. The method recited in claim 6 wherein A=7, B=3, C=2, and D=5.

10. A method of playing a game of chance utilizing a computerized video-game apparatus capable of displaying images of playing cards on a video-display screen wherein card hands are ranked from low to high in order of high card, pair, two-pair, three-of-a-kind, straight, flush, full house, four-of-a-kind, straight flush, royal flush, and five-of-a-kind, said video-display screen having a first-hand dealer zone, an original-hand player zone, a second-hand player zone, and a third-hand player zone, said method comprising the steps of:

a player registering a wager with said computerized video-game apparatus;

said player directing said computerized video-game apparatus to randomly generate an original hand having A cards and a first hand having B cards where A and B are integers, such that B is not equal to A, from a pool comprising elements corresponding to a deck of playing cards, said original hand being displayed in said original-hand player zone, said first hand being displayed face down in said first-hand dealer zone, said original hand having an original-hand ranking, said first hand having a first-hand ranking;

said computerized video-game apparatus displaying guiding means for helping said player evaluate said original-hand ranking:

said player directing said computerized video-game apparatus to arrange said original hand into a second hand having C cards and a third hand having D cards where C and D are integers, such that C+D=A, said second hand having a second-hand ranking, said third hand having a third-hand ranking, said third-hand ranking being greater than or equal to said second-hand ranking;

said computerized video-game apparatus comparing said second-hand ranking to said third-hand ranking and displaying said second hand in said second-hand player zone and said third hand in said third-hand player zone only if said third-hand ranking is greater than or equal to said second-hand ranking, said computerized video-game apparatus requiring said player to rearranged said second hand and said third hand if said second-hand ranking is greater than said third-hand ranking;

said player directing said computerized video-game apparatus to display said first hand face up and to compare said first-hand ranking to said second-hand ranking to determine if said player has lost or won said wager, said player winning said wager if said second-hand ranking is greater than said first-hand ranking, said player losing said wager if said first-hand ranking is greater than said second-hand ranking; and said player receiving a jackpot if said player has won said wager, said jackpot being determined according to a pay schedule calculated in proportion to said third-hand ranking.

11. The method recited in claim 10 wherein said deck of playing cards comprises 52 cards.

12. The method recited in claim 11 wherein said deck of playing cards further includes a Joker.

13. The method recited in claim 10 wherein said guiding means comprises identification symbols pointing out particular cards of said original hand forming any of said high card, pair, two-pair, three-of-a-kind, straight, flush, full house, four-of-a-kind, straight flush, royal flush, and five-of-a-kind card hands.

14. The method recited in claim 13 wherein said identification symbols comprise A graphic shapes, each of said graphic shapes being located proximate its respective card of said original hand.

15. The method recited in claim 14 wherein A=7, B=3, C=2, and D=5.

* * * * *